US010191398B2

(12) United States Patent
Ishida et al.

(10) Patent No.: US 10,191,398 B2
(45) Date of Patent: Jan. 29, 2019

(54) ELECTROPHOTOGRAPHIC PHOTOCONDUCTOR, IMAGE FORMING APPARATUS, AND PROCESS CARTRIDGE

(71) Applicants: Toshihiro Ishida, Shizuoka (JP); Tetsuro Suzuki, Shizuoka (JP); Eiji Kurimoto, Shizuoka (JP); Tomoharu Asano, Kanagawa (JP); Daisuke Nii, Shizuoka (JP)

(72) Inventors: Toshihiro Ishida, Shizuoka (JP); Tetsuro Suzuki, Shizuoka (JP); Eiji Kurimoto, Shizuoka (JP); Tomoharu Asano, Kanagawa (JP); Daisuke Nii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/601,220

(22) Filed: May 22, 2017

(65) Prior Publication Data

US 2017/0343910 A1 Nov. 30, 2017

(30) Foreign Application Priority Data

May 25, 2016 (JP) ..... 2016-104684

(51) Int. Cl.
*G03G 5/14* (2006.01)
*G03G 15/00* (2006.01)

(52) U.S. Cl.
CPC ..... *G03G 5/144* (2013.01); *G03G 15/75* (2013.01)

(58) Field of Classification Search
CPC ..... G03G 5/144; G03G 5/142; G03G 5/14
USPC ..... 430/60, 64, 65
See application file for complete search history.

(56) References Cited

U.S. PATENT DOCUMENTS

| | | | |
|---|---|---|---|
| 4,672,149 | A | 6/1987 | Yoshikawa et al. |
| 5,350,653 | A | 9/1994 | Shoshi et al. |
| 5,387,487 | A | 2/1995 | Shoshi et al. |
| 5,486,438 | A | 1/1996 | Shoshi et al. |
| 5,492,784 | A | 2/1996 | Yoshikawa et al. |
| 5,578,405 | A | 11/1996 | Ikegami et al. |
| 5,723,243 | A | 3/1998 | Sasaki et al. |
| 5,747,204 | A | 5/1998 | Anzai et al. |
| 5,830,980 | A | 11/1998 | Anzai et al. |
| 5,840,454 | A | 11/1998 | Nagai et al. |
| 2005/0221210 | A1 | 10/2005 | Suzuki et al. |
| 2005/0287452 | A1 | 12/2005 | Tamura et al. |
| 2006/0014096 | A1 | 1/2006 | Ohshima et al. |
| 2006/0068308 | A1 | 3/2006 | Ohshima et al. |
| 2006/0093955 | A1 | 5/2006 | Ohshima et al. |
| 2007/0009818 | A1 | 1/2007 | Yanagawa et al. |
| 2007/0031746 | A1 | 2/2007 | Toshine et al. |
| 2007/0212626 | A1 | 9/2007 | Toshine et al. |
| 2007/0212627 | A1 | 9/2007 | Yanagawa et al. |
| 2008/0085459 | A1 | 4/2008 | Kami et al. |
| 2008/0199217 | A1 | 8/2008 | Iwamoto et al. |
| 2008/0304867 | A1 | 12/2008 | Nagai et al. |
| 2008/0305426 | A1 | 12/2008 | Kurimoto et al. |
| 2010/0209842 | A1 | 8/2010 | Yanagawa et al. |
| 2010/0233602 | A1 | 9/2010 | Yamamoto et al. |
| 2013/0330104 | A1 | 12/2013 | Shimoyama et al. |
| 2015/0268569 | A1* | 9/2015 | Nukada ..... G03G 5/14 430/56 |
| 2016/0139517 | A1 | 5/2016 | Ishida et al. |
| 2016/0161871 | A1 | 6/2016 | Asano et al. |
| 2016/0334720 | A1 | 11/2016 | Ishida et al. |

FOREIGN PATENT DOCUMENTS

| | | | |
|---|---|---|---|
| JP | 10-055075 | | 2/1998 |
| JP | 10-083090 | | 3/1998 |
| JP | 2014-066756 | | 4/2014 |
| JP | 2014-191103 | A * | 10/2014 |
| JP | 2014-199400 | A * | 10/2014 |
| JP | 2016-212416 | | 12/2016 |

OTHER PUBLICATIONS

Diamond, A.S., ed. Handbook of Imaging Materials, Marcel Dekker, Inc., NY (1991), pp. 395-396.*
Japanese Patent Office (JPO) J-PlatPat machine assisted English-language translation of JP 2014-191103 (pub. Oct. 2014).*
Japanese Patent Office (JPO) J-PlatPat machine assisted English-language translation of JP 2014-199400 (pub. Oct. 2014).*
U.S. Appl. No. 15/331,313, filed Oct. 21, 2016.

* cited by examiner

*Primary Examiner* — Janis L Dote
(74) *Attorney, Agent, or Firm* — Oblon, McClelland, Maier & Neustadt, L.L.P.

(57) ABSTRACT

An electrophotographic photoconductor including a support, an undercoat layer, and a photoconductive layer, the undercoat layer and the photoconductive layer being disposed on the support in an order mentioned, wherein the undercoat layer includes zinc oxide particles, a urethane bond-containing resin, and methylethyl ketone oxime, and the undercoat layer satisfies a formula below:

$$10<M/L<400 \quad \text{(Formula)}$$

where M is a ratio (ppm) of the methylethyl ketone oxime included in the undercoat layer, and L is an average thickness (μm) of the undercoat layer.

13 Claims, 4 Drawing Sheets

ELECTROPHOTOGRAPHIC PHOTOCONDUCTOR, IMAGE FORMING APPARATUS, AND PROCESS CARTRIDGE

CROSS-REFERENCE TO RELATED APPLICATIONS

The present application claims priority under 35 U.S.C. § 119 to Japanese Patent Application No. 2016-104684 filed May 25, 2016. The contents of which are incorporated herein by reference in their entirety.

BACKGROUND OF THE INVENTION

Field of the Invention

The present disclosure relates to an electrophotographic photoconductor, and an image forming apparatus and a process cartridge both using the electrophotographic photoconductor.

Description of the Related Art

In an image forming method using an image forming apparatus, an image is formed by performing steps, such as a charging step, an exposure step, a developing step, a transfer step, and a charge-eliminating step, on an electrophotographic photoconductor (may be referred to as a "photoconductor" hereinafter). The electrophotographic photoconductor typically has a structure including a support, an undercoat layer formed on the support, and a photoconductive layer disposed on the undercoat layer. Organic materials are widely used for the undercoat layer and the photoconductive layer because of advantages, such as flexibility, thermal stability, and film formation properties.

When the electrophotographic photoconductor is used over a long period, deteriorations in electrical properties, such as reduction in chargeability due to electrostatic load, gradually occur because a charging step and a charge-eliminating step are repeatedly performed on the electrophotographic photoconductor. It has been known that deteriorations of the electrical properties largely influence image quality of output images, leading to serious problems, such as low image density, occurrences of background fog (may be also referred to as background deposition, fogging, or black spots, hereinafter), and low uniformity of images when continuously output.

In order to stabilize electrical properties of the electrophotographic photoconductor and image quality, for example, proposed is an electrophotographic photoconductor including an undercoat layer to which metal oxide particles and oximes are added (see, for example, Japanese Unexamined Patent Application Publication No. 2014-66756). However, the proposed electrophotographic photoconductor cannot maintain stable electrical properties and image quality when used over a long period.

Accordingly, there is a strong demand for developing an electrophotographic photoconductor that can obtain sufficiently stable electrical properties and image quality over a long period.

SUMMARY OF THE INVENTION

According to one aspect of the present disclosure, an electrophotographic photoconductor includes a support, an undercoat layer, and a photoconductive layer. The undercoat layer and the photoconductive layer are disposed on the support in an order mentioned. The undercoat layer includes zinc oxide particles, a urethane bond-containing resin, and methylethyl ketone oxime, and satisfies a formula below, $$10<M/L<400 \quad \text{(Formula)}$$

where M is a ratio (ppm) of the methylethyl ketone oxime included in the undercoat layer, and L is an average thickness (μm) of the undercoat layer.

DESCRIPTION OF THE EMBODIMENTS

Figure 1:
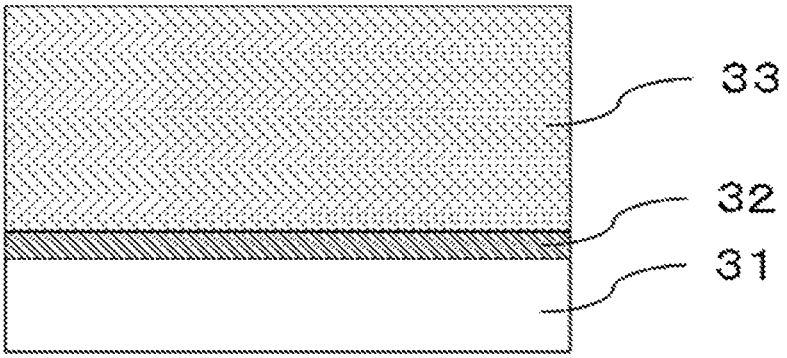
FIG. 1 is a schematic view illustrating one example of a layer configuration of an electrophotographic photoconductor of the present disclosure.

The present disclosure has an object to provide an electrophotographic photoconductor, which can obtain sufficiently stable electrical properties, even when the electrophotographic photoconductor is used over a long period, and does not cause a residual image or background fog during image formation, even when the electrophotographic photoconductor is used over a long period.

The present disclosure can provide an electrophotographic photoconductor, which can obtain sufficiently stable electrical properties, even when the electrophotographic photoconductor is used over a long period, and does not cause a residual image or background fog during image formation, even when the electrophotographic photoconductor is used over a long period.

(Electrophotographic Photoconductor)

An electrophotographic photoconductor of the present disclosure includes a substrate, an undercoat layer, and a photoconductive layer. The undercoat layer and the photoconductive layer are disposed on the support in an order mentioned. The electrophotographic photoconductor may further include other layers if necessary.

The electrophotographic photoconductor of the present disclosure is includes materials specified in the present disclosure in the undercoat layer. The support, the photoconductive layer, and the above-mentioned other layers can include materials used in the art.

<Undercoat Layer>

The undercoat layer includes zinc oxide particles, a urethane bond-containing resin, and methylethyl ketone oxime. The undercoat layer preferably further includes a salicylic acid derivative, and may further include other ingredients, if necessary.

The undercoat layer has a function of completely sealing a support with a uniform film (anti-leak function), a function of preventing injection of unnecessary charge (charge having a reverse polarity to a polarity of charge of the electrophotographic photoconductor) from the support into a photoconductive layer (charge-injection inhibition function), and a function of transporting charge having the identical polarity to the polarity of the charge of the electrophotographic photoconductor among the charge formed in the electroconductive layer (charge-transporting function). In order to obtain an electrophotographic photoconductor that is stable over a long period, it is important that the above-mentioned properties are not charged by electrostatic load applied by repetitive use. It has been difficult for an undercoat layer used in the art to have all of the above-mentioned properties.

The present inventors diligently conducted researches. As a result, the present inventors have found that the above-described properties can be achieved when the undercoat layer includes zinc oxide particles, a urethane bond-containing resin, and methylethyl ketone oxime, and satisfies a formula below, $$10<M/L<400 \quad \text{(Formula)}$$

where M is a ratio (ppm) of the methylethyl ketone oxime included in the undercoat layer, and L is an average thickness (μm) of the undercoat layer.

<<Zinc Oxide Particles>>

An average particle based on the number (may be referred to as a "number average particle diameter" hereinafter) of the zinc oxide particles is appropriately selected depending on the intended purpose. The number average particle is preferably from 20 nm through 200 nm, and more preferably from 50 nm through 150 nm. When the number average particle diameter is from 20 nm through 200 nm, the zinc oxide particles are excellently dispersed in the undercoat layer, and excellent electrical properties are obtained.

As a method for producing the zinc oxide particles, any of various production methods known in the art can be used, as long as zinc oxide particles having a number average particle diameter of from 20 nm through 200 nm can be produced. Examples of the method include a dry method and a wet method.

Examples of the dry method include the French method and the American method. The French method is a production method where metal zinc is heated to turn the metal zinc into zinc vapor to oxidize, followed by cooling the zinc vapor to produce zinc oxide. The American method is a production method where zinc ore is heated with a reducing agent to perform reduction and evaporation, and the obtained metal vapor is oxidized with air to produce zinc oxide.

Examples of the wet method include the German method and a zinc hydroxide method. The German method is a production method where white basic zinc carbonate deposits obtained by adding a soda ash solution to an aqueous solution of zinc sulfate or zinc chloride are washed with water and dried, followed by calcinating the zinc carbonate to produce zinc oxide. The zinc hydroxide method is a production method where zinc hydroxide is generated, washed with water, and dried, followed by calcinating the zinc hydroxide at about 1,000° C., to grow zinc hydroxide particles into particles in the size of several micrometers. Zinc hydroxide produced by the zinc hydroxide method may be used for pottery making, and is also called fired zinc oxide.

Note that, the zinc oxide particles produced by the wet method may include alkali metal ions or sulfuric acid ions originated from the production method.

Moreover, there is a method utilizing thermal decomposition of zinc oxalate in order to obtain zinc oxide particles of an ultrafine particle class (≤0.1 μm).

A number average particle diameter of the zinc oxide particles can be determined by observing randomly selected 100 particles among the particles observed in the undercoat layer under a transmission electron microscope (TEM) to determine a projected area of each particle, calculating a circle equivalent diameter of the obtained projected area to determine an average particle diameter, and determine the obtained average value as a number average particle diameter.

A volume resistivity (powder resistivity) of the zinc oxide particles is not particularly limited and may be appropriately selected depending on the intended purpose. The volume resistivity is preferably from $10^2\Omega\cdot$cm through $10^{11}\Omega\cdot$cm. When the volume resistivity is from $10^2\Omega\cdot$cm through $10^{11}\Omega\cdot$cm, an anti-leak function of the undercoat layer is obtained, formation of abnormal images, such as background fog, can be prevented, and charge transfer from the photoconductive layer to the support is sufficiently performed to prevent an increase in residual potential.

An amount of the zinc oxide particles in the undercoat layer is not particularly limited and may be appropriately selected depending on the intended purpose. The amount is preferably from 10% by mass through 80% by mass, more preferably from 30% by mass through 60% by mass. When the amount is from 10% by mass through 80% by mass, the volume resistivity of the undercoat layer does not increase and hence excellent electrical properties are maintained, and occurrences of leakage due to cracks formed after the film formation is prevented and hence excellent electrical properties are maintained.

<<<Surface Treatment Agent>>>

The zinc oxide particles may be subjected to a surface treatment with a surface treatment agent. Examples of the surface treatment agent include ethyltrimethoxysilane, diisopropyldimethoxysilane, isobutyltrimethoxysilane, diisobutyldimethoxysilane, isobutyltriethoxysilane, phenyltrimethoxysilane, phenyltriethoxysilane, n-propyltrimethoxysilane, n-propyltriethoxysilane, n-hexyltrimethoxysilane, n-hexyltriethoxysilane, cyclohexylmethyldimethoxysilane, n-octytriethoxysilane, n-decyltrimethoxysilane, vinyltrimethoxysilane, γ-methacryloxypropyl-tris(β-methoxyethoxy)silane, β-(3,4-epoxycylohexyl)ethyltrimethoxysilane, γ-glycidoxypropyltrimethoxysilane, vinyl triacetoxy silane, γ-mercaptopropyltrimethoxysilane, γ-aminopropyltriethoxysilane, N-β-(aminoethyl)-γ-aminopropylytimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. The above-listed examples may be used alone or in combination.

Examples of a method for treating the zinc oxide particles with the surface treatment agent include a dry method and a wet method.

—Dry Method—

Examples of the dry method include a method, in which the surface treatment agent is directly dripped or the surface treatment agent dissolved in an organic solvent is dripped, and sprayed together with dry air or nitrogen gas, while the zinc oxide particles are stirred with a mixer of a large shearing force, to thereby uniformly treat the zinc oxide particles. When the surface treatment agent is dripped and sprayed, the dripping and spraying are preferably performed at a temperature equal to or lower than a boiling point of the organic solvent. When the surface treatment agent is sprayed at a temperature higher than a boiling point of the organic solvent, the organic solvent is evaporated before the surface treatment agent is homogeneously stirred, the surface treatment agent is locally solidified, and therefore a treatment cannot be performed uniformly. After dripping and spraying the surface treatment agent, moreover, baking may be performed at 100° C. or higher. The baking is not particularly limited and may be appropriately selected depending on the intended purpose, as long as the baking is performed at a temperature and for a duration, with which desired electrophotographic properties can be obtained.

—Wet Method—

Examples of the wet method include a method, in which the zinc oxide particles are dispersed in a solvent by stirring, ultrasonic waves, a sand mill, an attritor, or a ball mill, and the surface treatment agent is added to the obtained dispersion liquid, followed by stirring or dispersing, and thereafter the solvent is removed, to thereby perform the treatment uniformly. Examples of a method for removing the solvent include filtration and evaporation. After removing the solvent, baking may be performed at 100° C. or higher. The baking is not particularly limited and may be appropriately selected depending on the intended purpose, as long as the baking is performed at a temperature and for a duration, with which desired electrophotographic properties can be obtained. In the wet method, a moisture contained in the zinc oxide particles may be removed before adding the surface treatment agent. Examples of a method for removing the contained moisture include: a method where the moisture is removed in the solvent used for the surface treatment by stirring and heating; and a method where the moisture is removed by allowing to perform azeotropy with the solvent.

Whether surfaces of the zinc oxide particles are covered with the surface treatment agent or not can be confirmed, for example, by surface analysis methods, such as photoelectron spectroscopy (ESCA), Auger electron spectroscopy, time-of-flight secondary ion mass spectrometry (TOF-SIMS), and Fourier transform infrared spectroscopy (FT-IR).

<<Urethane Bond-Containing Resin>>

The urethane bond-containing resin is not particularly limited and may be appropriately selected depending on the intended purpose. The urethane bond-containing resin is preferably a urethane bond-containing resin obtained by heat curing a compound including an isocyanate group and a compound including a hydroxyl group.

Examples of the compound including an isocyanate group include tolylene diisocyanate (TDI), diphenylmethane diisocyanate (MDI), hexamethylene diisocyanate (HDI), and isophorone diisocyanate (IPDI). The above-listed examples may be used alone or in combination. Among the above-listed examples, HDI is preferable.

The compound including an isocyanate group is preferably blocked isocyanate, in which isocyanate is blocked with a compound called a blocking agent in order to inhibit progress of a reaction at room temperature.

The blocking agent is appropriately selected depending on the intended purpose. Examples of the blocking agent include alcohols, phenols, lactams, oximes, alkyl acetoacetates, alkyl malonates, phthalimides, imidazoles, hydrogen chloride, hydrogen cyanide, and sodium hydrogen sulfite. Among the above-listed examples, oximes are preferable.

The oximes may be appropriately selected depending on the intended purpose. As the oximes, methylethyl ketone oxime is preferable because the methylethyl ketone oxime has a low boiling point. The blocking agent having a low boiling point has advantages that an amount of residues in the undercoat layer is small, and the blocking agent has little influence to electrical properties.

The blocked isocyanate may be appropriately synthesized for use, or selected from commercial products. Examples of the commercial products include SUMIDUR BL3175 (available from Sumitomo Bayer Urethane Co., Ltd.).

Whether the undercoat layer includes a urethane bond-containing resin or not can be confirmed, for example, by Fourier-transform infrared spectroscopy (FT-IR).

The compound including a hydroxyl group is not particularly limited and may be appropriately selected depending on the intended purpose, as long as the compound including a hydroxyl group can react with the compound including the isocyanate group to form a urethane bond-containing resin. The compound including a hydroxyl group is preferably a resin.

Examples of the resin include butyral resins and polyvinyl alcohol.

<<Methylethyl Ketone Oxime>>

The undercoat layer satisfies a formula below.

$$10<M/L<400 \quad \text{(Formula)}$$

In the formula, M is a ratio (ppm) of the methylethyl ketone oxime included in the undercoat layer, and L is an average thickness (μm) of the undercoat layer.

The M/L is greater than 10 but less than 400, preferably 50 or greater but less than 350, and more preferably 70 or greater but less than 120. When the M/L is 10 or less, pealing of the undercoat layer and formation of abnormal images, such as black spots, may be caused. When the M/L is 400 or greater, residual potential of the undercoat layer may become high.

A ratio of the methylethyl ketone oxime included in the undercoat layer is preferably from 200 ppm through 5,000 ppm, more preferably from 600 ppm through 3,000 ppm.

A method for adjusting an amount of the methylethyl ketone oxime in the undercoat layer is not particularly limited and may be appropriately selected depending on the intended purpose. The method is preferably a method where the amount is adjusted with a heat treatment temperature or a heat treatment duration of the undercoat layer.

For example, the amount of the methylethyl ketone oxime can be measured by GC/MS.

<<Salicylic Acid Derivative>>

The salicylic acid derivative is included for improving dispersibility of the zinc oxide particles and improving electrical properties.

Examples of the salicylic acid derivative include salicylic acid, acetylsalicylic acid, 5-acetylsalicylic acid, 3-aminosalicylic acid, 5-acetylsalicylamide, 5-ammosalicylic acid, 4-azidesalicylic acid, benzyl salicylate, 4-tert-butylphenyl salicylate, butyl salicylate, 2-carboxyphenyl salicylate, 3,5-dinitrosalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4-methylsalicylic acid, 5-methylsalicylic acid, methyl thiosalicylate, 4-nitrophenyl salicylate, 5-nitrosalicylic acid, 4-nitrosalicylic acid, 3-nitrosalicylic acid, 4-octylphenyl salicylate, phenyl salicylate, 3-acetoxy-2-naphthanlide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-diltydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naplithoate, and phenyl 1-hydroxy-2-naphthoate. The above-listed examples may be used alone or in combination.

<<Other Ingredients>>

The undercoat layer may include other ingredients to improve electrical properties, environmental stability, and image quality.

The above-mentioned other ingredients are not particularly limited and may be appropriately selected depending on the intended purpose. Examples of the above-mentioned other ingredients include: electron-transporting materials; electron-transporting pigments, such as fused polycyclic pigments and azo-pigments; silane-coupling agents; zirconium chelating compounds; titanium chelating compounds; aluminium chelating compounds; fluorenone compounds; titanium alkoxide compounds; organic titanium compounds; and antioxidants, plasticizers, lubricants, ultraviolet absorbing agents, and leveling agents, which are described later. The above-listed ingredients may be used alone or in combination.

<<Method for Forming Undercoat Layer>>

A method for forming the undercoat layer is not particularly limited. For example, the undercoat layer can be formed by a method described below. The zinc oxide particles, a compound including an isocyanate group blocked with methylethyl ketone oxime, a compound including a hydroxyl group, and optionally the salicylic acid derivative and other ingredients are dissolved in an appropriate solvent to prepare a coating liquid. Next, the coating liquid is applied onto the support by an appropriate coating method, followed by heating and drying the coating liquid.

As a result of the heating and drying, the compound including an isocyanate group and the compound including a hydroxyl group are allowed to react to thereby form a urethane bond-containing resin.

Note that, the timing for adding the compound including an isocyanate group and the compound including a hydroxyl group to an undercoat layer coating liquid used as the above-mentioned coating liquid may be before or after dispersing the metal oxide particles.

The solvent is not particularly limited and may be appropriately selected depending on the intended purpose. Examples of the solvent include: alcohol-based solvents, such as methanol, ethanol, propanol, and butanol; ketone-based solvents, such as acetone, methyl ethyl ketone, methyl isobutyl ketone, and cyclohexanone; ester-based solvents, such as ethyl acetate, and butyl acetate; ether-based solvents, such as tetrahydrofuran, dioxane, and propylether; halogen-based solvents, such as dichloromethane, dichloroethane, trichloroethane, and chlorobenzene; aromatic-based solvents, such as benzene, toluene, and xylene; and cellosolve-based solvents, such as methyl cellosolve, ethyl cellosolve, and cellosolve acetate. The above-listed examples may be used alone or in combination.

A method for dispersing the zinc oxide particles in the undercoat layer coating liquid is not particularly limited and may be appropriately selected depending on the intended purpose. Examples of the method include dispersing methods using ball mills, sand mills, vibration mills, three-roll mills, attritors, pressure homogenizers, and ultrasonic wave dispersers.

The coating method is not particularly limited, and is appropriately selected depending on a viscosity of the coating liquid, and a desired average thickness of an undercoat layer. Examples of the coating method include clip coating, spray coating, bead coating, and ring coating.

A heating temperature and a heating duration of the heating and drying vary depending on a device for heating and drying, a material of a support, and an average thickness of a support. The heating temperature and the heating duration are not particularly limited and may be appropriately selected depending on the intended purpose, as long as an amount of the methylethyl ketone oxime in the undercoat layer satisfies (Formula) above. The heating temperature is preferably from 140° C. through 170° C., more preferably from 150° C. through 160° C., and the heating duration is preferably 20 minutes or longer but 30 minutes or shorter.

<<Average Thickness of Undercoat Layer>>

An average thickness of the undercoat layer is not particularly limited, and may be appropriately selected depending on desired electrical properties and service life of an electrophotographic photoconductor to be produced. The average thickness is preferably from 7 μm through 25 μm, and more preferably from 7 μm through 15 μm.

When the average thickness is from 7 μm through 25 μm, charging failures due to a flow of a charge of reverse polarity to the polarity of the charge of the surface of the electrophotographic photoconductor from the support into the photoconductive layer, formation of image defects in the form of background fog due to the charging failures, deteriorations of a light attenuation function, such as an increase in residual potential, and reduction in stability of repetitive use can be prevented.

Moreover, examples of a measuring method of the average thickness include a method, in which arbitral points are selected on the undercoat layer, and an average of the thicknesses at the points is calculated to determine the average thickness. The average is preferably an average of thicknesses measured at 5 points, more preferably an average of thicknesses measured at 10 points, and even more preferably an average of thicknesses measured at 20 points. Note that, the average thickness of another layer can be calculated in the same manner.

Examples of a device for measuring the average thickness include a micrometer.

<Photoconductive Layer>

The photoconductive layer may be a single-layer photoconductive layer or a laminate photoconductive layer.

<<Single-layer Photoconductive Layer>>

The single-layer photoconductive layer is a layer having a charge-generating function and a charge-transporting function at the same time.

The single-layer photoconductive layer includes a charge-generating material, a charge-transporting material, and a binder resin, and may further include other ingredients, if necessary.

—Charge-generating Material—

The charge-generating material is not particularly limited and may be appropriately selected depending on the intended purpose. Examples of the charge-generating material include materials identical or similar to materials used in a laminate photoconductive layer described below. An amount of the charge-generating material is not particularly limited and may be appropriately selected depending on the intended purpose. The amount of the charge-generating material is preferably from 5 parts by mass through 40 parts by mass relative to 100 parts by mass of the binder resin.

—Charge-transporting Material—

The charge-transporting material is not particularly limited and may be appropriately selected depending on the intended purpose. Examples of the charge-transporting material include materials identical or similar to materials used in a laminate photoconductive layer described below. An amount of the charge-transporting material is not particularly limited and may be appropriately selected depending on the intended purpose. The amount of the charge-transporting material is preferably 190 parts by mass or less, more preferably from 50 parts by mass through 150 parts by mass, relative to 100 parts by mass of the binder resin.

—Binder Resin—

The binder resin is not particularly limited and may be appropriately selected depending on the intended purpose. Examples of the binder resin include binder resins identical or similar to binder resins used in a laminate photoconductive layer described below.

—Other Ingredients—

The above-mentioned other ingredients are not particularly limited and may be appropriately selected depending on the intended purpose. Examples of the above-mentioned other ingredients include a low-molecular-weight charge-transporting material and a solvent, which are identical to a low-molecular-weight charge-transporting material and a solvent used in a laminate photoconductive layer described below, and an antioxidant, a plasticizer, a lubricant, an ultraviolet absorbing agent, and a leveling agent, which will be described below.

—Method for Forming Single-layer Photoconductive Layer—

The method for forming the single-layer photoconductive layer is not particularly limited and may be appropriately selected depending on the intended purpose. Examples of the method include a method, in which a charge-generating material, a charge-transporting material, a binder resin, other ingredients, etc., are dissolved and dispersed in an appropriate solvent (e.g., tetrahydrofuran, dioxane, dichloroethane, and cyclohexane) by a disperser to prepare a coating liquid, and the coating liquid is applied and dried to form a single-layer photoconductive layer.

A method for coating the coating liquid is not particularly limited and may be appropriately selected depending on the intended purpose. Examples of the method include dip coating, spray coating, bead coating, and ring coating. Moreover, a plasticizer, a leveling agent, an antioxidant, etc., may be added to the coating liquid, if necessary.

An average thickness of the single-layer photoconductive layer is not particularly limited and may be appropriately selected depending on the intended purpose. The average thickness is preferably from 5 μm through 25 μm.

<<Laminate Photoconductive Layer>>

The laminate photoconductive layer includes a charge-generating layer and a charge-transporting layer because a charge-generating function and a charge-transporting function are independently exhibited by the separate layers. As the charge-generating layer and the charge-transporting layer, any of charge-generating layers and charge-transporting layers known in the art can be used.

In the laminate photoconductive layer, an order for disposing the charge-generating layer and the charge-transporting layer is not particularly limited and may be appropriately selected depending on the intended purpose. The charge-transporting layer is preferably disposed on the charge-generating layer. The charge-generating layer and the charge-transporting layer are disposed in the above-described manner in order to prevent the following problems. Most of charge-generating materials have poor chemical stability, and a charge generating efficiency is lowered when the charge-generating material is exposed to acidic gas, such as discharge products, at a surrounding area of a charger in the process of electrophotographic image formation.

—Charge-generating Layer—

The charge-generating layer includes a charge-generating material, preferably includes a binder resin, and may further include, if necessary, other ingredients, such as an antioxidant, which will be described later.

——Charge-generating Material——

The charge-generating material is not particularly limited and may be appropriately selected depending on the intended purpose. Examples of the charge-generating material include inorganic materials and organic materials.

———Inorganic Materials———

The inorganic materials are not particularly limited and may be appropriately selected depending on the intended purpose. Examples of the inorganic materials include crystalline selenium, amorphous-selenium, selenium-tellurium, selenium-tellurium-halogen, selenium-arsenic compounds, and amorphous silicon (for example, amorphous silicon, in which a dangling bond is terminated with a hydrogen atom or a halogen atom, and amorphous silicon including a boron atom, or a sulfur atom are preferable).

———Organic Material———

The organic material is not particularly limited and may be appropriately selected depending on the intended purpose. Examples of the organic material include: phthalocyanine-based pigments, such as metal phthalocyanine, and metal-free phthalocyanine; azlenium salts pigments; squaric acid methine pigments; azo pigments including carbzole skeletons; azo pigments including triphenylamine skeletons; azo pigments including diphenylamine skeletons; azo pigments including dibenzothiophene skeletons; azo pigments including fluorenone skeletons; azo pigments including oxadiazole skeletons; azo pigments including bisstilbene skeletons; azo pigments including dlisstyryloxadiazole skeletons; azo pigments including disstyrylcarbazole skeletons; perylene-based pigments; anthraquinone-based or polycyclic quinone-based pigments; quinoneimine-based pigments; diphenylmethane-based pigments and triphenylmethane-based pigments; benzoquinone-based pigments and naphthoquinone-based pigments; cyanine-based pigments and azomethine-based pigments; indigoid-based pigments; and bisbenzimidazole-based pigments. The above-listed examples may be used alone or in combination.

——Binder Resin——

The binder resin is not particularly limited and may be appropriately selected depending on the intended purpose. Examples of the binder resin include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, and polyacrylamide resins. The above-listed binder resins may be used alone or in combination.

In addition to the above-mentioned binder resins, the binder resin may include a charge-transporting polymer material having a charge-transporting function. Examples of the charge-transporting polymer material include: polymer materials (e.g. polycarbonate, polyester, polyurethane, polyether, polysiloxane, and acrylic resins) having an arylamine skeleton, a benzidine skeleton, a hydrazone skeleton, a carbazole skeleton, a stilbene skeleton, and a pyrazolines skeleton; and polymer materials having a polysilane skeleton.

——Other Ingredients——

The above-mentioned other ingredients are not particularly limited and may be appropriately selected depending on the intended purpose. Examples of the above-mentioned other ingredients include low-molecular-weight charge-transporting materials, solvents, antioxidants, plasticizers, lubricants, ultraviolet absorbing agents, and leveling agents, where the antioxidants, the plasticizers, the lubricants, the ultraviolet absorbing agents, and the leveling agents will be described later.

An amount of the other components is not particularly limited and may be appropriately selected depending on the intended purpose. The amount is preferably in a range of from 0.01% by mass through 10% by mass relative to the total mass of the coating liquid for the charge generating layer.

———Low-molecular-weight Charge-transporting Material———

The low-molecular-weight charge-transporting material is not particularly limited and may be appropriately selected depending on the intended purpose. Examples of the low-molecular-weight charge-transporting material include electron-transporting materials and hole-transporting materials.

The electron-transporting materials are not particularly limited and may be appropriately selected depending on the intended purpose. Examples of the electron-transporting materials include chloranil, bromanil, tetracyanoethylene, tetracyanoquinodimethane, 2,4, 7-trinitro-9-fluorenone, 2,4, 5,7-tetranitro-9-fluorenone, 2,4,5, 7-tetranitroxanthone, 2,4, 8-trinitrothioxanthone, 2,6,8-trinitro-4H-indeno[1,2-b]thiophen-4-one, 1,3,7-trinitrodibenzothiophene-5,5-dioxide, and diphenoquinone derivatives. The above-listed materials may be used alone or in combination.

The hole-transporting materials are not particularly limited and may be appropriately selected depending on the intended purpose. Examples of the hole-transporting materials include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazolines derivatives, divinylbenzene derivatives, hydrazone derivatives, indene derivatives, butadiene derivatives, pyrene derivatives, bis-stilbene derivatives, and enamine derivatives. The above-listed materials may be used alone or in combination.

———Solvent———

The solvent is not particularly limited and may be appropriately selected depending on the intended purpose. Examples of the solvent include tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate, and butyl acetate. The above-listed solvents may be used alone or in combination.

——Method for Forming Charge-generating Layer——

A method for forming the charge-generating layer is not particularly limited and may be appropriately selected depending on the intended purpose. Examples of the method include a method in which the charge-generating material and the binder resin are dissolved and dispersed in the above-mentioned other ingredients, such as the solvent to obtain a coating liquid, and the coating liquid is applied onto the support by coating, followed by drying to obtain the charge-generating layer. Note that, the coating liquid can be applied by casting.

An average thickness of the charge-generating layer is not particularly limited and may be appropriately selected depending on the intended purpose. The average thickness of the charge-generating layer is preferably from 0.01 μm through 5 μm and more preferably from 0.05 μm through 2 μm.

—Charge-transporting Layer—

The charge-transporting layer is a layer that retains charges, and transfers charges generated and separated through exposure in the charge-generating layer to be combined with the retained charges. In order to achieve the object of retaining the charges, the charge-transporting layer is required to have high electric resistance. In order that the retained charges obtain high surface potential, the charge-transporting layer is required to have low permittivity and good electric charge mobility.

The charge-transporting layer includes a charge-transporting material, preferably includes a binder resin, and further includes other ingredients, if necessary.

——Charge-transporting Material——

The charge-transporting material is not particularly limited and may be appropriately selected depending on the intended purpose. Examples of the charge-transporting material include electron-transporting materials, hole-transporting materials, and polymer charge-transporting materials.

An amount of the charge-transporting material relative to a total amount of the charge-transporting layer is not particularly limited and may be appropriately selected depending on the intended purpose. The amount of the charge-transporting material is preferably from 20% by mass through 90% by mass and more preferably from 30% by mass through 70% by mass.

When the amount is from 20% by mass through 90% by mass, desired optical attenuating properties can be obtained without lowering charge-transporting properties of the charge-transporting layer, and the electrophotographic photoconductor is not worn more than necessary due to various hazards the electrophotographic photoconductor receives.

Moreover, the amount of from 30% by mass through 70% by mass is advantageous because desired optical attenuating properties can be obtained, and also an electrophotographic photoconductor with a small amount of abrasion from use can be obtained.

———Electron-transporting Material———

The electron-transporting material (electron-accepting material is not particularly limited and may be appropriately selected depending on the intended purpose. Examples of the electron-transporting material include chloranil, bromanil, tetracyanoethylene, tetracyanoquinodimethane, 2,4,7-trinitro-9-fluorenone, 2,4,5,7-tetranitro-9-fluorenone, 2,4,5, 7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. The above-listed materials may be used alone or in combination.

———Hole-transporting Material———

The hole-transporting material (electron-donating material) is not particularly limited and may be appropriately selected depending on the intended purpose. Examples of the hole-transporting material include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. The above-listed materials may be used alone or in combination.

———Polymer Charge-transporting Material———

The polymer charge-transporting material is a material having both the function of the charge-transporting material and the function of the binder resin, which will be described later.

The polymer charge-transporting material is not particularly limited and may be appropriately selected depending on the intended purpose. Examples of the polymer charge-transporting material include polymers including a carbazole ring, polymers including a hydrazone structure, polysilylene polymers, polymers including a triarylamine structure (e.g., polymers including a triarylamine structure disclosed in Japanese Patent No. 3852812 and Japanese Patent No. 3990499 etc.), polymers including an electron donating group, and other polymers. The above-listed materials may be used alone or in combination. The polymer charge-transporting material may be used in combination with a below-described binder resin in view of abrasion resistance and film-forming properties.

An amount of the polymer charge-transporting material relative to a total mass of the charge-transporting layer is not particularly limited and may be appropriately selected depending on the intended purpose.

In the case where the polymer charge-transporting material is used in combination with the below-described binder resin, the amount is preferably from 40% by mass through 90% by mass, and more preferably from 50% by mass through 80% by mass.

——Binder Resin——

The binder resin is not particularly limited and may be appropriately selected depending on the intended purpose. Examples of the binder resin include polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinylformal resins, polyacrylate resins, polyacrylamide resins, and phenoxy resins. The above-listed binder resins may be used alone or in combination.

The charge-transporting layer may include a copolymer of a cross-linking binder resin and a cross-linking charge-transporting material.

——Other Ingredients——

The above-mentioned other ingredients are not particularly limited and may be appropriately selected depending on the intended purpose. Examples of the above-mentioned other ingredients include a solvent, an antioxidant, a plasticizer, a lubricant, an ultraviolet absorbing agent, and a leveling agent, where the antioxidant, the plasticizer, the lubricant, the ultraviolet absorbing agent, and the leveling agent will be described later.

An amount of the above-mentioned other ingredients is not particularly limited and may be appropriately selected depending on the intended purpose. The amount is preferably from 0.01% by mass through 10% by mass relative to a total mass of the layer to which the above-mentioned other ingredients are added.

———Solvent———

The solvent is not particularly limited and may be appropriately selected depending on the intended purpose. The solvent can be the same solvent as used in the preparation of the charge-generating layer. However, a solvent that can favorably dissolve the charge-transporting material and the binder resin is preferable. The above-mentioned solvents may be used alone or in combination.

——Method for Forming Charge-transporting Layer——

A method for forming the charge-transporting layer is not particularly limited and may be appropriately selected depending on the intended purpose. Examples of the method include a method, in which a coating liquid is applied onto a charge-generating layer by coating, the applied coating liquid is heated and dried to form a charge-transporting layer, where the coating liquid is obtained by dissolving or dispersing the charge-transporting material and the binder resin in the above-mentioned other components (e.g., a solvent).

A method for applying the coating liquid used during the formation of the charge-transporting layer is not particularly limited and may be appropriately selected depending on the intended purpose, such as viscosity of the coating liquid and a desired average thickness of the charge-transporting layer. Examples of the method include dip coating, spray coating, bead coating, and ring coating.

In view of electrophotographic properties and viscosity of a film, the solvent needs to be removed from charge-transporting layer by a method for heating the charge-transporting layer described below.

Examples of the method include a method in which air, gas (e.g., nitrogen), vapor, or heat energy (e.g., various heating media, infrared rays, and electromagnetic rays) is used to heat the charge-transporting layer from the side of the coated surface or the side of the support.

A temperature at which the charge-transporting layer is heated is not particularly limited and may be appropriately selected depending on the intended purpose. The temperature is preferably from 100° C. through 170° C.

When the temperature is lower than 100° C., the organic solvent in the film cannot be removed sufficiently, which may cause deteriorations of electrophotographic properties or abrasion resistance. When the temperature is higher than 170° C., not only generating lime-peel-like defects or cracks on a surface of the film and causing peeling at an interface between the charge-transporting layer and an adjacent layer, but also dispersing volatile ingredients in the photoconductive layer outside. As a result, desired electrical properties may not be obtained.

An average thickness of the charge-transporting layer is not particularly limited and may be appropriately selected depending on the intended purpose. The average thickness is preferably 50 μm or less, more preferably 45 μm or less in view of resolution and responsiveness. A lower limit of the average thickness varies depending on a system to be used (particularly, charge electric potential, etc.). The lower limit is preferably 5 μm or more.

<Support>

The support is not particularly limited and may be appropriately selected depending on the intended purpose, as long as the support has conductivity such that volume resistivity of the support is $1\times10^{10}\Omega\cdot$cm or less. Note that, an endless belt (e.g., endless nickel belt, and endless stainless belt) may be used as the support.

A method for forming the support is not particularly limited and may be appropriately selected depending on the intended purpose. Examples of the method include: a method in which the support (e.g., a film-like or cylindrical plastic or paper) is coated with a metal (e.g., aluminium, nickel, chromium, nichrome, copper, gold, silver, and platinum) or a metal oxide (e.g., tin oxide and indium oxide) through vapor deposition or sputtering; and a method in which a plate of a metal (e.g., aluminium, alloy of aluminium, nickel, and stainless steel) is extruded or drawn out, followed by a surface treatment (e.g., after forming an original tube, cutting, super-finishing, and polishing) to form the support.

Note that, a conductive layer may be disposed on the support.

A method for forming the conductive layer is not particularly limited and may be appropriately selected depending on the intended purpose. Examples of the method include: a method in which a coating liquid prepared by dispersing and dissolving conductive powder and a binder resin in a solvent, if necessary, is applied onto the support by coating; and a method in which a thermal shrinkage tube containing the conductive powder in materials (e.g., polyvinyl chloride, polypropylene, polyester, polystyrene, polyvinylidene chloride, polyethylene, chlorinated rubbers, and TEFLON (Registered Trademark)) is used to form the conductive layer.

The conductive powder is not particularly limited and may be appropriately selected depending on the intended purpose. Examples of the conductive powder include: carbon fine particles (e.g., carbon black and acetylene black); metal powder (e.g., aluminium, nickel, iron, nichrome, copper, zinc, and silver); and metal oxide powder (e.g., conductive tin oxide and ITO).

A binder resin used in the conductive layer is not particularly limited and may be appropriately selected depending on the intended purpose. Examples of the binder resin include thermoplastic resins, thermosetting resins, and photocurable resins. Specific examples of the binder resin include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyallylate resins, phenoxy resins, polycarbonate resins, cellulose acetate resins, ethyl cellulose resins, polyvinyl butyral resins, polyvinylformal resins, polyvinyl toluene resins, poly-N-vinylcarbazole, acrylic resins, silicone resins, epoxy resins, melamine resins, urethane resins, phenol resins, and alkyd resins.

A solvent used in the conductive layer is not particularly limited and may be appropriately selected depending on the intended purpose. Examples of the solvent include tetrahydrofuran, dichloromethane, methylethylketone, and toluene.

<Other Layers>

The above-mentioned other layers are not particularly limited and may be appropriately selected depending on the intended purpose. Examples of the above-mentioned other layers include a protective layer, an intermediate layer, and a second undercoat layer.

<<Protective Layer>>

The protective layer (may be referred to as a surface layer hereinafter) can be disposed on the photoconductive layer in order to improve durability and other functions of the photoconductor. The protective layer includes a binder resin and fillers, and may further include other ingredients, if necessary.

—Binder Resin—

The binder resin is not particularly limited and may be appropriately selected depending on the intended purpose. Examples of the binder resin include AS resins, ABS resins, ACS resins, olefin-vinyl monomer copolymers, chlorinated polyether resins, allyl resins, phenol resins, polyacetal resins, polyamide resins, polyamide imide resins, polyacrylate resins, polyarylsulfone resins, polybutylene resins, polybutylene terephthalate resins, polycarbonate resins, polyethersulfone resins, polyethylene resins, polyethylene terephthalate resins, polyimide resins, acrylic resins, polymethyl pentene resins, polypropylene resins, polyphenylene oxide resins, polysulfone resins, polyurethane resins, polyvinyl chloride resins, polyvinylidene chloride resins, and epoxy resins. The above-listed binder resins may be used alone or in combination. Among the above-listed binder resins, the polycarbonate resins and the polyacrylate resins are preferable in view of dispersibility of the fillers, and reduction in residual potential and film defects.

—Fillers—

The fillers are not particularly limited and may be appropriately selected depending on the intended purpose. Examples of the fillers include metal oxide particles.

The metal oxide particles are not particularly limited and may be appropriately selected depending on the intended purpose Examples of the metal oxide particles include aluminium oxide, zinc oxide, titanium oxide, tin oxide, antimony oxide, indium oxide, bismuth oxide, tin-containing indium oxide, tin oxide containing antimony or tantalum, and antimony-containing zirconium oxide. The above-listed materials may be used alone or in combination.

A method for forming the protective layer is not particularly limited, and an appropriate solvent and appropriate coating method are used to form the protective layer as described in the formation of the above-described photoconductive layer. Examples of the coating method include dip coating, spray coating, bead coating, nozzle coating, spinner coating, and ring coating.

A solvent used in the method for forming the protective layer is not particularly limited and may be appropriately selected depending on the intended purpose. Examples of the solvent include tetrahydrofuran, dioxane, toluene, dichloromethane, monochlorobenzene, dichloroethane, cyclohexanone, methyl ethyl ketone, and acetone.

The solvent is preferably high in viscosity during dispersion of the binder resin and the fillers, and is preferably high in volatility during the coating. When there is no solvent satisfying the above-mentioned properties, two or more solvents having the above-mentioned properties can be mixed for use, which may result in a large effect on residual potential and dispersibility of the fillers.

It is effective and useful that any of the charge-transporting materials listed in the descriptions of the charge-transporting layer is added to the protective layer in view of reduction in residual potential and improvement in image quality.

An average thickness of the protective layer is not particularly limited and may be appropriately selected depending on the intended purpose. The average thickness is preferably from 1 μm through 5 μm in view of abrasion resistance.

<<Intermediate Layer>>

The intermediate layer can be disposed between the charge-transporting layer and the surface layer in order to prevent the surface layer from contamination of the components of the charge-transporting layer, or in order to improve adhesiveness between the charge-transporting layer and the surface layer.

The intermediate layer includes a binder resin, and may further include other ingredients, such as an antioxidant, which will be described later, if necessary. The intermediate layer is preferably insoluble or poorly soluble in the coating liquid for surface layer.

The binder resin included in the intermediate layer is not particularly limited and may be appropriately selected depending on the intended purpose. Examples of the binder resin include polyamide, alcohol-soluble nylon, polyvinyl butyral, and polyvinyl alcohol.

A method for forming the intermediate layer is not particularly limited and may be appropriately selected depending on the intended purpose. Examples of the method include a method in which an intermediate layer is formed using an appropriate solvent and an appropriate coating method, which are identical or similar to the solvent and the coating method used in the formation of the photoconductive layer.

An average thickness of the intermediate layer is not particularly limited and may be appropriately selected depending on the intended purpose. The average thickness is preferably from 0.05 μm through 2 μm.

<<Second Undercoat Layer>>

In the electrophotographic photoconductor, the second undercoat layer can be disposed between the support and the undercoat layer, or between the undercoat layer and the photoconductive layer. The second undercoat layer includes a second binder resin, and may further include other ingredients, if necessary.

The second binder resin is not particularly limited and may be appropriately selected depending on the intended purpose. Examples of the second binder resin include polyamide, alcohol-soluble nylon, water-soluble polyvinyl butyral, polyvinyl butyral, and polyvinyl alcohol.

A method for forming the second undercoat layer is not particularly limited. The second undercoat layer can be formed using an appropriate solvent and an appropriate coating method.

An average thickness of the second undercoat layer is not particularly limited and may be appropriately selected depending on the intended purpose. The average thickness is preferably from 0.05 μm through 2 μm.

In order to improve the electrophotographic photoconductor of the present disclosure in resistance to environment, particularly to prevent the electrophotographic photoconductor of the present disclosure from deteriorating in sensitivity and raising residual potential, other ingredients can be added to each of the layers (e.g., the charge-generating layer, the charge-transporting layer, the undercoat layer, the protective layer, and the second undercoat layer). Examples of the above-mentioned other ingredients include an antioxidant, a plasticizer, a lubricant, an ultraviolet absorbing agent, and a leveling agent.

The antioxidant is not particularly limited and may be appropriately selected depending on the intended purpose. Examples of the antioxidant include phenol compounds, paraphenylene diamines, hydroquinones, organic sulfur compounds, and organic phosphorus compounds. The above-listed examples may be used alone or in combination.

The plasticizer is not particularly limited and may be appropriately selected depending on the intended purpose. Examples of the plasticizer include plasticizers of general resins such as dibutyl phthalate and dioctyl phthalate. The above-listed examples may be used alone or in combination.

The lubricant is not particularly limited and may be appropriately selected depending on the intended purpose. Examples of the lubricant include hydrocarbon compounds, fatty acid compounds, fatty acid amide compounds, ester compounds, alcohol compounds, metal soaps, natural waxes, and other lubricants. The above-listed examples may be used alone or in combination.

The ultraviolet absorbing agent is not particularly limited and may be appropriately selected depending on the intended purpose. Examples of the ultraviolet absorbing agent include benzophenone ultraviolet absorbing agents, salicylate ultraviolet absorbing agents, benzotriazole ultraviolet absorbing agents, cyanoacrylate ultraviolet absorbing agents, quenchers (metal complex salt ultraviolet absorbing agents), and hindered amines stabilizers (HALS). The above-listed examples may be used alone or in combination.

The leveling agent is not particularly limited and may be appropriately selected depending on the intended purpose. Examples of the leveling agent include silicone oils such as dimethyl silicone oils and methylphenyl silicone oils; and polymers or oligomers containing a perfluoroalkyl group at a side chain. The above-listed examples may be used alone or in combination.

[Embodiments of Electrophotographic Photoconductor]

Embodiments of the electrophotographic photoconductor of the present disclosure will be described later.

<First Embodiment>

A layer configuration of the electrophotographic photoconductor according to a first embodiment will be described with reference to FIG. 1.

FIG. 1 illustrates a layer configuration including a single-layer photoconductive layer, and illustrates a layer configuration of the electrophotographic photoconductor where an undercoat layer 32 and a single-layer photoconductive layer 33 are sequentially disposed on a support 31.

<Second Embodiment>

A layer configuration of the electrophotographic photoconductor according to a second embodiment will be described with reference to FIG. 2.

Figure 2:
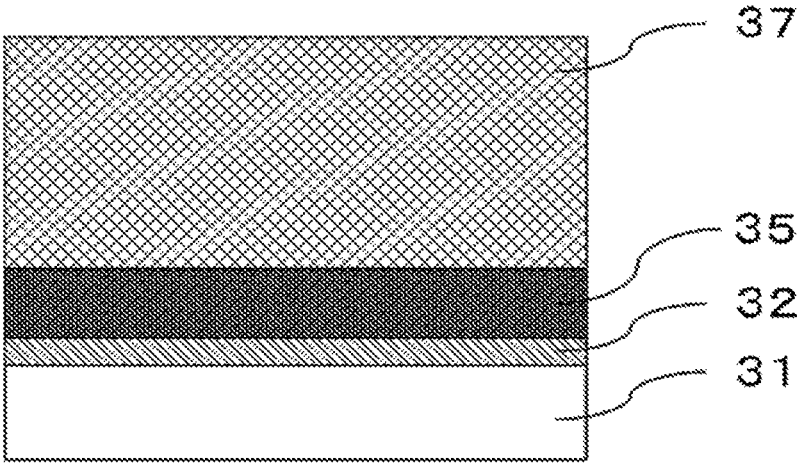
FIG. 2 is a schematic view illustrating one example of a layer configuration of the electrophotographic photoconductor of the present disclosure.

FIG. 2 illustrates a layer configuration including a laminate photoconductive layer, and illustrates a layer configuration of the electrophotographic photoconductor where an undercoat layer 32, a charge-generating layer 35, and a charge-transporting layer 37 are sequentially disposed on a support 31. Note that, a combination of the charge-generating layer 35 and the charge-transporting layer 37 corresponds to a photoconductive layer.

<Third Embodiment>

A layer configuration of the electrophotographic photoconductor according to a third embodiment will be described with reference to FIG. 3.

Figure 3:
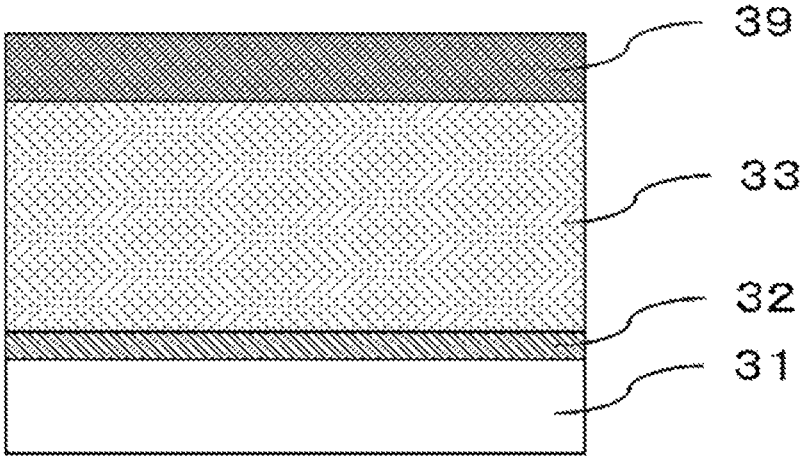
FIG. 3 is a schematic view illustrating one example of a layer configuration of the electrophotographic photoconductor of the present disclosure.

FIG. 3 illustrates a layer configuration including a single-layer photoconductive layer, and illustrate a layer configuration of the electrophotographic photoconductor where an undercoat layer 32, a photoconductive layer 33, and a protective layer 39 are sequentially disposed on a support 31.

<Fourth Embodiment>

A layer configuration of the electrophotographic photoconductor according to a fourth embodiment will be described with reference to FIG. 4.

Figure 4:
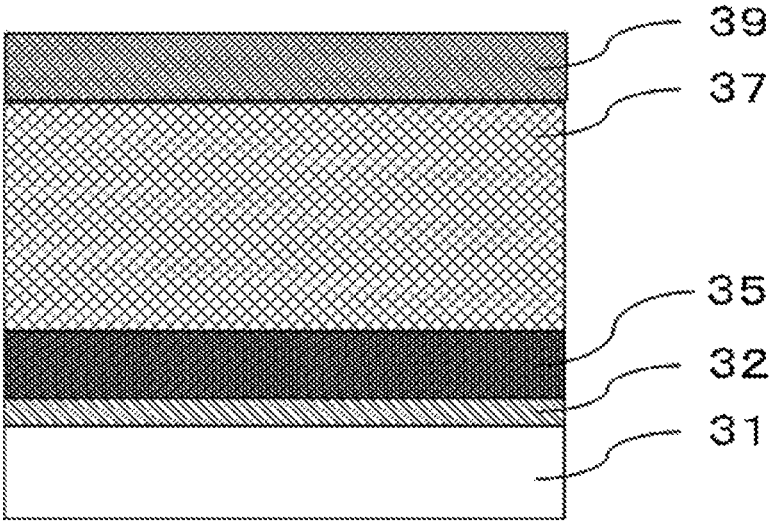
FIG. 4 is a schematic view illustrating one example of a layer configuration of the electrophotographic photoconductor of the present disclosure.

FIG. 4 illustrates a layer configuration including a laminate photoconductive layer, and illustrates a layer configuration of the electrophotographic photoconductor where an undercoat layer 32, a charge-generating layer 35, a charge-transporting layer 37, and a protective layer 39 are sequentially disposed on a support 31. Note that, a combination of the charge-generating layer 35 and the charge-transporting layer 37 corresponds to a photoconductive layer.

(Image Forming Apparatus)

An image forming apparatus of the present disclosure includes an electrophotographic photoconductor, a charging unit configured to charge a surface of the electrophotographic photoconductor, an exposure unit configured to expose the surface of the electrophotographic photoconductor charged to light to form an electrostatic latent image, a developing unit configured to develop the electrostatic latent image with a toner to form a visible image, and a transfer unit configured to transfer the visible image to a recording medium. The image forming apparatus may further include other units, if necessary. The electrophotographic photoconductor used in the image forming apparatus is the above-described electrophotographic photoconductor of the present disclosure. Note that, the charging unit and the exposure unit may be collectively referred to as an electrostatic latent image-forming unit.

[Embodiments of Image Forming Apparatus]

An embodiment of the image forming apparatus of the present disclosure will be described later.

Figure 5:
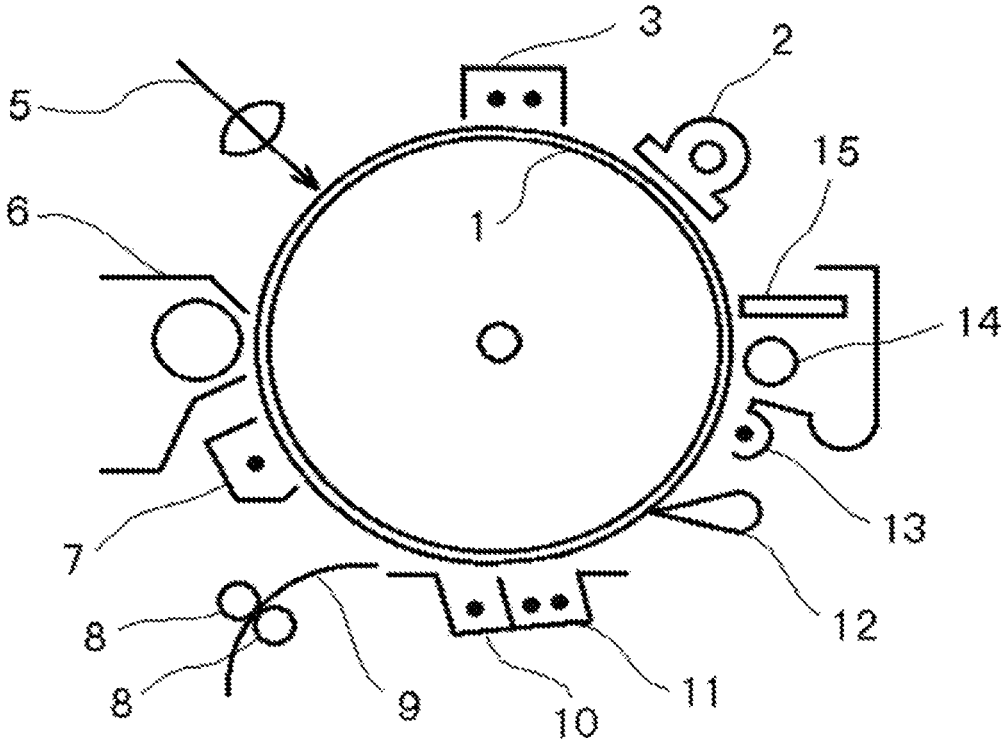
FIG. 5 is a schematic view illustrating one example of an image forming apparatus of the present disclosure.

FIG. 5 is a schematic view illustrating one example of a section adjacent to an electrophotographic photoconductor in the image forming apparatus of the present disclosure, and illustrates that a charging unit 3, an exposure unit 5, a developing unit 6, a transfer unit 10, etc., are disposed around an electrophotographic photoconductor 1.

In FIG. 5, first, the charging unit 3 uniformly charges the electrophotographic photoconductor 1. As the charging unit 3, a corotron device, a scorotron device, a solid-state discharging element, a multi-stylus electrode, a roller charging device, a conductive brush device, etc., are used, and typically known systems can be used.

Next, the exposure unit 5 forms an electrostatic latent image on the uniformly charged surface of the electrophotographic photoconductor 1. As a light source of the exposure unit 5, general luminescent products, such as a fluorescent lamp, a tungsten lamp, a halogen lamp, a mercury lamp, a sodium-vapor lamp, a light-emitting diode (LED), a laser diode (LD), and electroluminescence (EL), can be used. In order to emit light having a predetermined wavelength, various filters such as a sharp cut filter, a band pass filter, a near infrared cut filter, a dichroic filter, an interference filter, and a color conversion filter can be used.

Next, the developing unit 6 develops the electrostatic latent image formed on the surface of the electrophotographic photoconductor 1 with a toner to form a visualized toner image. Examples of a developing system used include a one-component development method using a dry toner, a two-component development method, and a wet developing method using a wet toner. When the electrophotographic photoconductor 1 is applied with positive (negative) charge, followed by performing imagewise exposure, a positive (negative) electrostatic latent image is formed on a surface of the electrophotographic photoconductor. When the electrostatic latent image is developed with a toner (electroscopic particles) of negative (positive) polarity, a positive image is obtained. When the electrostatic latent image is developed with a toner of positive (negative) polarity, a negative image is obtained.

Next, the toner image (visible image) visualized on the surface of the electrophotographic photoconductor 1 is transferred onto a recording medium 9 by the transfer unit 10. In order for the toner image to be favorably transferred, moreover, a pre-transfer charger 7 may be used. As the transfer unit 10, an electrostatic transfer system using a transfer charger or a bias roller, a mechanical transfer system (e.g., an adhesive transfer method and a pressure transfer method), or a magnetic transfer system can be used.

A separation charger 11 and a separation claw 12 may be used as a unit configured to separate the recording medium 9 from the electrophotographic photoconductor 1, if necessary. As other separating units, electrostatic attraction induced separation, side-edge belt separation, tip-grip conveyance, and self stripping are used. As the separation charger 11, the charging unit can be used. In order to clean the toner remaining on the electrophotographic photoconductor after the image is transferred, a cleaning unit such as a fur brush 14 and a cleaning blade 15 is used. A pre-cleaning charger 13 may be used in order to effectively perform the cleaning. Examples of other cleaning units include a web system and a magnetic brush system. The above-listed systems may be used alone or two or more systems may be used together. Moreover, a charge-eliminating unit 2 may be used for removing an electrostatic latent image on the surface of the electrophotographic photoconductor 1. As the charge-eliminating unit 2, a charge-eliminating lamp or a charge-eliminating charger may be used. A light source of the exposure unit 5 or the charging unit 3 can be used. As other processes performed not adjacent to the electrophotographic photoconductor 1, such as scanning documents, paper feeding, fixing, and paper ejection, processes known in the art can be used.

The charging unit, the exposure unit, the developing unit, the transfer unit, etc., in the image forming apparatus, which have been described above, may be incorporated by fixing the above-mentioned units in a photocopier, a facsimile, or a printer, but may be incorporated in the form of a process cartridge, which will be explained below, in an image forming apparatus.

(Process Cartridge)

A process cartridge of the present disclosure includes an electrophotographic photoconductor, and at least one selected from the group consisting of a charging unit configured to charge a surface of the electrophotographic photoconductor, an exposure unit configured to expose a surface of the electrophotographic photoconductor charged to light to form an electrostatic latent image, a developing unit configured to develop the electrostatic latent image with a toner to form a visible image, and a transfer unit configured to transfer the visible image to a recording medium. The process cartridge may further include other units, if necessary.

The electrophotographic photoconductor used in the process cartridge of the present disclosure is the above-described electrophotographic photoconductor of the present disclosure.

[Embodiment of Process Cartridge]

An embodiment of the process cartridge of the present disclosure will be described below.

Figure 6:
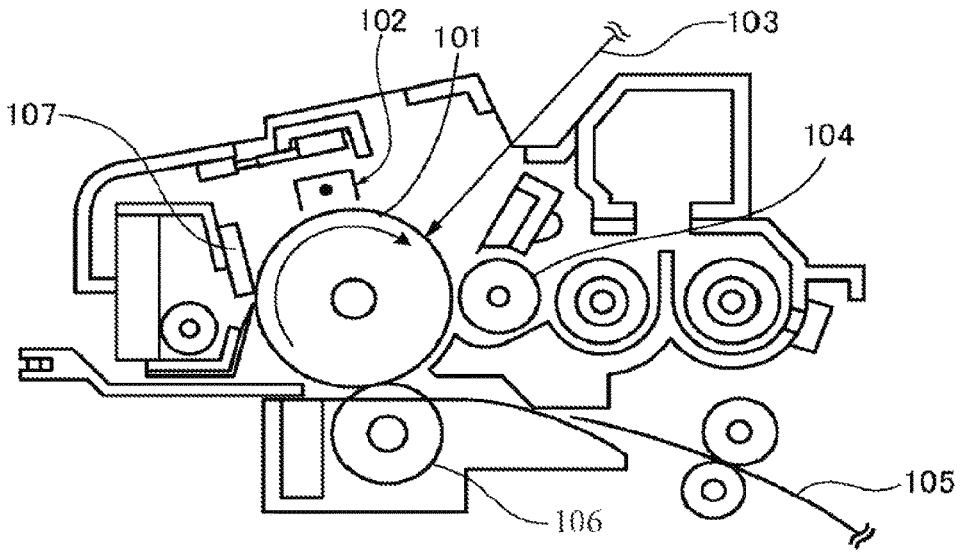
FIG. 6 is a schematic view illustrating one example of a process cartridge of the present disclosure.
Figure 7:
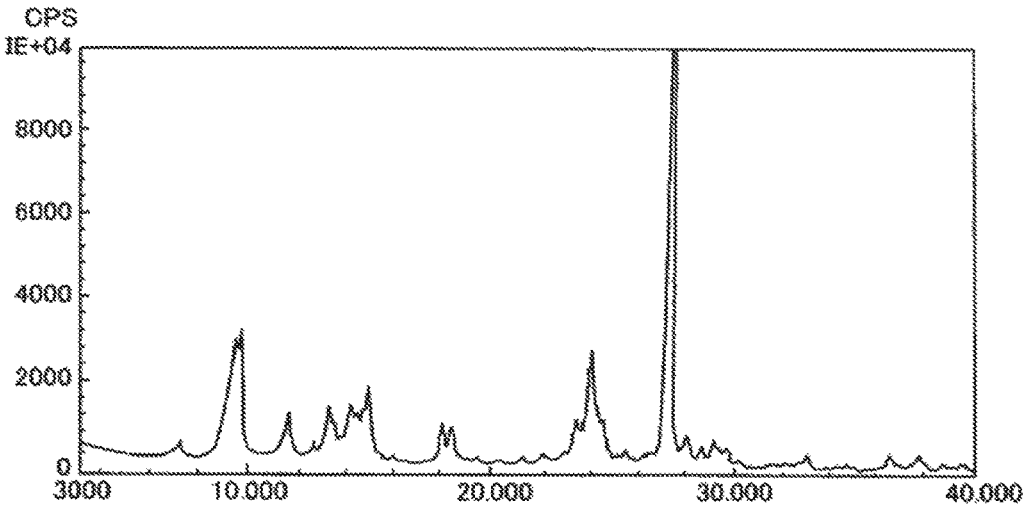
FIG. 7 is a graph presenting an X-ray diffraction spectrum of titanyl phthalocyanine used as a charge-generating material in Examples, where a vertical axis represents the number of counts per second (cps) and a horizontal axis represents an angle (2θ).

FIG. 6 is a schematic view illustrating one example of the process cartridge of the present disclosure.

In FIG. 6, the process cartridge includes an electrophotographic photoconductor 101, and at least one selected from the group consisting of a charging unit 102, a developing unit 104, a transfer unit 106, a cleaning unit 107, and a charge-eliminating unit, and the process cartridge is a device (component) that is detachably mounted on a main body of the image forming apparatus.

An image forming step performed by a process cartridge will be described. The electrophotographic photoconductor 101 is charged by the charging unit 102 while rotating in a direction indicated with an arrow in FIG. 6, followed by being exposed to light by the exposure unit 103, to thereby form an electrostatic latent image on a surface of the electrophotographic photoconductor. The electrostatic latent image is developed into a toner image by the developing unit 104, the toner image is transferred to a recording medium 105 by the transfer unit 106, and then the toner image on the recording medium is output (printed out). After transferring the toner image, the surface of the electrophotographic photoconductor 101 is cleaned by the cleaning unit 107, and moreover the charge of the surface of the electrophotographic photoconductor is eliminated by the charge-eliminating unit (not illustrated). Then, the above-described process is again repeated.

EXAMPLES

The present disclosure will be described in detail with reference to the following Examples and Comparative Examples hereinafter. However, it is noted that the present disclosure is not limited to these Examples. Here, the unit "part(s)" used in Examples means "part(s) by mass" unless otherwise stated.

Example 1

<Undercoat Layer Coating Liquid 1>

Materials presented below were mixed, and the resultant mixture was stirred for 5 hours by using zirconia beads each having a diameter of 0.3 mm and a bead mill, to thereby prepare Undercoat Layer Coating Liquid 1.

Butyral resin: 10 parts (BM-1, available from SEKISUI CHEMICAL CO., LTD.)

Blocked isocyanate including methylethyl ketone oxime: 13.3 parts (SUMIDUR BL3175, available from Sumitomo Bayer Urethane Co., Ltd.)

Zinc oxide particles: 80 parts (MZ-200, available from TAYCA CORPORATION)

Solvent (2-butanone): 111.7 parts

<Charge-generating Layer Coating Liquid>

Materials below were mixed, and the resultant mixture was stirred for 8 hours by using glass beads each having a diameter of 1 mm and a bead mill, to thereby prepare a charge-generating layer coating liquid. Note that, a powder X-ray diffraction spectrum of titanyl phthalocyanine below is presented in FIG. 6.

Charge-generating material (titanyl phthalocyanine): 8 parts

Binder resin (polyvinyl butyral): 5 parts (S-LEC BX-1, available from SEKISUI CHEMICAL CO., LTD.)

Solvent (2-butanone): 400 parts

<Charge-transporting Layer Coating Liquid>

Materials below were mixed, and the resultant mixture was stirred until all of the materials were dissolved, to thereby prepare a charge-transporting layer coating liquid.

Charge-transporting material (charge-transporting material represented by Structural Formula (1)): 7 parts <Structural Formula (1)>

Structural Formula (1)

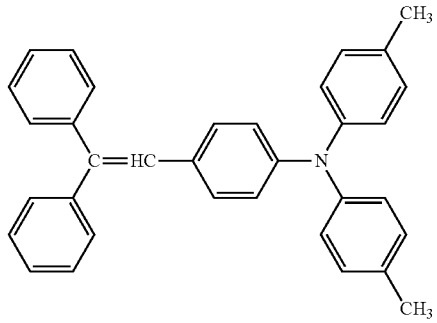

Binder resin (polycarbonate): 10 parts (TS-2050, available from TEIJIN LIMITED)

Leveling agent (silicone oil): 0.0005 parts (KF-50, available from Shin-Etsu Chemical Co., Ltd.)

Solvent (tetrahydrofuran): 100 parts

After applying Undercoat Layer Coating Liquid 1 onto an aluminium cylinder (diameter: 100 mm, length: 380 mm) by dip coating, the applied coating liquid was dried for 20 minutes at 150° C. to thereby dispose an undercoat layer having an average thickness of 7.5 μm. Next, the charge-generating layer coating liquid was applied onto the undercoat layer by dip coating, followed by drying the applied coating liquid for 30 minutes at 90° C., to thereby dispose a charge-generating layer having an average thickness of 0.2 μm. Moreover, the charge-transporting layer coating liquid was applied onto the charge-generating layer by dip coating, followed by drying the applied coating liquid for 30 minutes at 130° C. to dispose a charge-transporting layer having an average thickness of 25 μm, to thereby produce an electrophotographic photoconductor of Example 1.

Example 2

An electrophotographic photoconductor of Example 2 was produced in the same manner as in Example 1, except that drying after applying Undercoat Layer Coating Liquid 1 was performed for 30 minutes at 165° C. to dispose an undercoat layer having an average thickness of 23.2 μm.

Example 3

An electrophotographic photoconductor of Example 3 was produced in the same manner as in Example 1, except that Undercoat Layer Coating Liquid 1 was replaced with Undercoat Layer Coating Liquid 2 below, and drying after applying the undercoat layer coating liquid was performed for 30 minutes at 150° C. to dispose an undercoat layer having an average thickness of 10.3 μm.

<Undercoat Layer Coating Liquid 2>

Materials below were mixed, and the resultant mixture was stirred for 5 hours by using zirconia beads each having a diameter of 0.3 mm and a bead mill to thereby prepare Undercoat Layer Coating Liquid 2.

Butyral resin: 10 parts (BM-1, available from SEKISUI CHEMICAL CO., LTD.)

Blocked isocyanate including methylethyl ketone oxime: 13.3 parts (SUMIDUR BL3175, available from Sumitomo Bayer Urethane Co., Ltd.)

Zinc oxide particles: 80 parts (MZ-200, available from TAYCA CORPORATION)
Salicylic acid derivative (salicylic acid): 1.5 parts
Solvent (2-butanone): 111.7 parts Example 4

An electrophotographic photoconductor of Example 4 was produced in the same manner as in Example 1, except that Undercoat Layer Coating Liquid 1 was replaced with Undercoat Layer Coating Liquid 3 below, and drying after applying the undercoat layer coating liquid was performed for 20 minutes at 150° C. to dispose an undercoat layer having an average thickness of 19.5 μm.

<Undercoat Layer Coating Liquid 3>

Materials below were mixed, and the resultant mixture was stirred for 5 hours by using zirconia beads each having a diameter of 0.3 mm and a bead mill, to thereby prepare Undercoat Layer Coating Liquid 3.

Butyral resin: 10 parts
(BM-1, available from SEKISUI CHEMICAL CO., LTD.)
Blocked isocyanate including methylethyl ketone oxime: 13.3 parts
(SUMIDUR BL3175, available from Sumitomo Bayer Urethane Co., Ltd.)
Zinc oxide particles: 80 parts
(MZ-200, available from TAYCA CORPORATION)
Salicylic acid derivative [3,5-di-tert-butylsalicylic acid (DBSA)]: 1.5 parts
Solvent (2-butanone): 111.7 parts Example 5

An electrophotographic photoconductor of Example 5 was produced in the same manner as in Example 1, except that Undercoat Layer Coating Liquid 1 was replaced with Undercoat Layer Coating Liquid 2, and drying after applying the undercoat layer coating liquid was performed for 30 minutes at 160° C. to dispose an undercoat layer having an average thickness of 8.5 μm.

Example 6

An electrophotographic photoconductor of Example 6 was produced in the same manner as in Example 1, except that Undercoat Layer Coating Liquid 1 was replaced with Undercoat Layer Coating Liquid 2, and drying after applying the undercoat layer coating liquid was performed for 30 minutes at 150° C. to dispose an undercoat layer having an average thickness of 22.3 μm.

Example 7

An electrophotographic photoconductor of Example 7 was produced in the same manner as in Example 1, except that Undercoat Layer Coating Liquid 1 was replaced with Undercoat Layer Coating Liquid 2, and drying after applying the undercoat layer coating liquid was performed for 30 minutes at 140° C. to dispose an undercoat layer having an average thickness of 13.5 μm.

Example 8

An electrophotographic photoconductor of Example 8 was produced in the same manner as in Example 1, except that Undercoat Layer Coating Liquid 1 was replaced with Undercoat Layer Coating Liquid 3, and drying after applying the undercoat layer coating liquid was performed for 30 minutes at 150° C. to dispose an undercoat layer having an average thickness of 17.7 μm.

Example 9

An electrophotographic photoconductor of Example 9 was produced in the same manner as in Example 1, except that Undercoat Layer Coating Liquid 1 was replaced with Undercoat Layer Coating Liquid 3, and drying after applying the undercoat layer coating liquid was performed for 20 minutes at 150° C. to dispose an undercoat layer having an average thickness of 9.7 μm.

Comparative Example 1

An electrophotographic photoconductor of Comparative Example 1 was produced in the same manner as in Example 1, except that drying after applying Undercoat Layer Coating Liquid 1 was performed for 30 minutes at 135° C. to dispose an undercoat layer having an average thickness of 19.3 μm.

Comparative Example 2

An electrophotographic photoconductor of Comparative Example 2 was produced in the same manner as in Example 1, except that Undercoat Layer Coating Liquid 1 was replaced with Undercoat Layer Coating Liquid 2, and drying after applying the undercoat layer coating liquid was performed for 40 minutes at 170° C. to dispose an undercoat layer having an average thickness of 11.1 μm.

Comparative Example 3

An electrophotographic photoconductor of Comparative Example 3 was produced in the same manner as in Example 1, except that Undercoat Layer Coating Liquid 1 was replaced with Undercoat Layer Coating Liquid 4, and drying after applying the undercoat layer coating liquid was performed for 40 minutes at 170° C. to dispose an undercoat layer having an average thickness of 23.0 μm. Note that, a value of M/L becomes smaller, as the drying temperature is higher than 170° C.

<Undercoat Layer Coating Liquid 4>

Materials below were mixed, and the resultant mixture was stirred for 5 hours by using zirconia beads each having a diameter of 0.3 mm and a bead mill, to thereby prepare Undercoat Layer Coating Liquid 4. Note that, among the additives, additives other than alizarin were added after completing the stirring performed by the zirconia beads and the bead mill.

Butyral resin: 7.6 parts
(BM-1, available from SEKISUI CHEMICAL CO., LTD.)
Blocked isocyanate including methylethyl ketone oxime: 18 parts
(SUMIDUR BL3175, available from Sumitomo Bayer Urethane Co., Ltd.)
Zinc oxide particles: 80 parts
(MZ-300, available from TAYCA CORPORATION)
Solvent (2-butanone): 76.4 parts
Additive (alizarin): 0.8 parts
Additive (dioctyltin dilaurate): 0.005 parts
Additive (silicone resin particles): 5.3 parts
(Tosperal 145, available from Momentive Performance Materials Inc.)
Additive(methylethyl ketone oxime): 1.3 parts Comparative Example 4

An electrophotographic photoconductor of Comparative Example 4 was produced in the same manner as in Example 1, except that Undercoat Layer Coating Liquid 1 was replaced with Undercoat Layer Coating Liquid 5 below, and drying after applying the undercoat layer coating liquid was performed for 30 minutes at 150° C. to dispose an undercoat layer having an average thickness of 15.3 μm.

<Undercoat Layer Coating Liquid 5>

Materials below were mixed, and the resultant mixture was stirred for 5 hours by using zirconia beads each having a diameter of 0.3 mm and a bead mill, to thereby prepare Undercoat Layer Coating Liquid 5. Note that, among the additives, additives other than alizarin were added after completing the stirring performed by the zirconia beads and the bead mill.

Butyral resin: 10 parts (BM-1, available from SEKISUI CHEMICAL CO., LTD.)

Blocked isocyanate including methylethyl ketone oxime: 13.3 parts (SUMIDUR BL3175, available from Sumitomo Bayer Urethane Co., Ltd.)

Titanium oxide particles: 80 parts (TTO-55A, available from ISHIHARA SANGYO KAISHA, LTD.)

Solvent (2-butanone): 111.7 parts

<Ratio of Methylethyl Ketone Oxime in Undercoat Layer>

A section of about 50 mm×about 30 mm of the obtained electrophotographic photoconductor from a center in a longitudinal direction was cut out, and the charge-transporting layer and the charge-generating layer were peeled off to collect the undercoat layer and the support. Thereafter, the obtained undercoat layer and support piece was cut into a small piece in the size of about 10 mm×about 3 mm. The obtained small piece was measured by means of GC/NIS (GC-2010 and GCMS-Q2010, both available from SHIMADZU CORPORATION), and a pyrolyzer (EGA/PY-3030, available from Frontier Laboratories Ltd.).

An amount of the methylethyl ketone oxime contained in the small piece was calculated from the peak area of m/z=87 obtained by the measurement, and a peak area of m/z=87 obtained from a diluted liquid of methylethyl ketone oxide having a known concentration.

The undercoat layer was removed from the small piece that had been subjected to the measurement, and a mass of the small piece before and after the measurement was compared to calculate a mass of the undercoat layer. A ratio of the methylethyl ketone oxime contained in the small piece was calculated from the calculated mass of the undercoat layer contained in the small piece and the amount of the methylethyl ketone oxide contained in the small piece, to thereby calculate a ratio [ratio (ppm) of methylethyl ketone oxime/average thickness (μm) of undercoat layer]. The results are presented in Table 1.

<Average Thickness of Undercoat Layer>

The average thickness of the undercoat layer was determined by measuring the thickness of the undercoat layer at 10 points by means of an electronic micrometer (available from ANRITSU CORPORATION), and determining an average value of the measured values.

<Evaluation of Electrophotographic Photoconductor>

<<Evaluation Device>>

A modified device of a digital photocopier (RICOH ProC900, available from Ricoh Company Limited) was used. In the modified device, a scorotron charging member (a discharge wire was a tungsten-molybdenum alloy plated with gold, having a diameter of 50 μm) was used as a charging member, LD light of 780 nm (writing by a polygon mirror, resolution: 1,200 dpi) was used as an image exposure light source, two-component developing using a black toner was performed as developing, a transfer belt was used as a transfer member, and a charge-eliminating lamp was used for charge elimination.

<<Deterioration Test of Electrophotographic Photoconductor>>

A test chart (an image area ratio of 5%) of a black single color was continuously output on 20,000 sheets under a normal temperature and humidity environment of 23° C. and 55% RH to apply load to the photoconductor.

<<Evaluation of Electrical Properties (Chargeability, Residual Potential, and Potential Variation of Exposure Area)>>

A surface potential of the electrophotographic photoconductor was measured before and after the deterioration test of the electrophotographic photoconductor. The measurement of the potential was performed according to the following method by modifying the developing unit of the evaluation device to attach a potential sensor, and setting the modified developing unit to the evaluation device.

A solid image formed on an entire A3-size sheet was printed in a longitudinal direction on 100 sheets with setting voltage applied to the wire to −1,800 μA, and grid voltage to −800 V. A charging potential (VD) and a potential of an exposure area (VL) at the time of printing on the first sheet and the $100^{th}$ sheet were measured respectively. For the measurement, a surface potential meter (MODEL344 surface potential meter, available from TREK JAPAN). The numerical value of the surface potential meter was recorded by an oscilloscope under the conditions of 100 signals or more per second, and was evaluated based on the following evaluation criteria. The evaluation results before the deterioration test are presented in Table 2, and the evaluation results after the deterioration test are presented in Table 3.

Note that, the electrophotographic photoconductors of Comparative Example 1 and Comparative Example 4 had high potentials on the exposure area before the deterioration test and could not obtain the desired image density. Therefore, the evaluations thereafter (variation of charging potential before the deterioration test, variation of potential of the exposure area, evaluation of background fog and residual image, and all the evaluation after the deterioration test) were not performed.

[Potential of Exposure Area]

The value indicates the potential of the exposure area at the time of printing the first sheet, as measured by the surface potential meter.

[Evaluation Criteria of Variation of Charging Potential]

A: The charging potential difference (ΔVD) between the first sheet and the $100^{th}$ sheet was less than 10 V.

B: The charging potential difference (ΔVD) between the first sheet and the $100^{th}$ sheet was 10 V or greater but less than 20 V.

C: The charging potential difference (ΔVD) between the first sheet and the $100^{th}$ sheet was 20 V or greater.

[Evaluation Criteria of Variation of Potential of Exposure Area]

A: The potential difference of the exposure area (ΔVL) between the first sheet and the $100^{th}$ sheet was less than 10 V.

B: The potential difference of the exposure area (ΔVL) between the first sheet and the $100^{th}$ sheet was 10 V or greater but less than 30 V.

C: The potential difference of the exposure area (ΔVL) between the first sheet and the $100^{th}$ sheet was 30 V or greater.

<Image Evaluation (Evaluation of Background Fog and Residual Image)>

An evaluation of background fog and an evaluation of a residual image were performed in the following manner before and after the deterioration test of the electrophotographic photoconductor. The results before the deterioration test are presented in Table 2, and the results after the deterioration test are presented in Table 3.

The evaluation of background fog was performed as follows. A white image on an entire area of gloss-coated paper was continuously output on 5 sheets, and background fog was evaluated based on the following evaluation criteria.

The evaluation of a residual image was performed as follows. An image having a "x" shaped pattern in the size of 3 cm×3 cm was continuously output on 3 sheets, followed by continuously output on 3 sheets with half-tone. The occurrence of the residual image was visually observed, and the residual image was evaluated based on the following evaluation criteria.

[Evaluation Criteria of Background Fog and Residual Image]

A: No abnormal image (a residual image or background fog) was observed.

B: An abnormal image was slightly observed.

C: A clear abnormal image was observed.

TABLE 1

| | Ratio (ppm) of methyl-ethyl ketone oxime in undercoat layer: M | Average thickness (μm) of undercoat layer: L | M/L | Salicylic acid derivative | Drying conditions (temperature, duration) |
|---|---|---|---|---|---|
| Ex. 1 | 2,888 | 7.5 | 385 | — | 150° C., 20 min |
| Ex. 2 | 306 | 23.2 | 13 | — | 165° C., 30 min |
| Ex. 3 | 435 | 10.3 | 42 | salicylic acid | 150° C., 30 min |
| Ex. 4 | 4,504 | 19.5 | 231 | DBSA | 150° C., 20 min |
| Ex. 5 | 219 | 8.5 | 26 | salicylic acid | 160° C., 30 min |
| Ex. 6 | 1,763 | 22.3 | 79 | salicylic acid | 150° C., 30 min |
| Ex. 7 | 4,225 | 13.5 | 313 | salicylic acid | 140° C., 30 min |
| Ex. 8 | 3,310 | 17.7 | 187 | DBSA | 150° C., 20 min |
| Ex. 9 | 954 | 9.7 | 98 | DBSA | 150° C., 30 min |
| Comp. Ex. 1 | 8,357 | 19.3 | 433 | — | 135° C., 30 min |
| Comp. Ex. 2 | 97 | 11.1 | 9 | salicylic acid | 170° C., 40 min |
| Comp. Ex. 3 | 71 | 23.0 | 3 | — | 170° C., 40 min |
| Comp. Ex. 4 | 1,321 | 15.3 | 86 | salicylic acid | 150° C., 30 min |

TABLE 2

| | Before deterioration test | | | | |
|---|---|---|---|---|---|
| | Exposure area potential | Charging potential variation | Exposure area potential variation | Background fog | Residual image |
| Ex. 1 | 115 V | B | B | B | A |
| Ex. 2 | 93 V | A | A | A | B |

TABLE 2-continued

| | Before deterioration test | | | | |
|---|---|---|---|---|---|
| | Exposure area potential | Charging potential variation | Exposure area potential variation | Background fog | Residual image |
| Ex. 3 | 102 V | B | A | A | A |
| Ex. 4 | 108 V | A | A | A | A |
| Ex. 5 | 87 V | A | A | A | A |
| Ex. 6 | 105 V | A | A | A | A |
| Ex. 7 | 110 V | A | A | A | A |
| Ex. 8 | 106 V | A | A | A | A |
| Ex. 9 | 91 V | A | A | A | A |
| Comp. Ex. 1 | 451 V | — | — | — | — |
| Comp. Ex. 2 | 81 V | A | A | C | B |
| Comp. Ex. 3 | 80 V | A | A | B | C |
| Comp. Ex. 4 | 355 V | — | — | — | — |

TABLE 3

| | After deterioration test | | | | |
|---|---|---|---|---|---|
| | Exposure area potential | Charging potential variation | Exposure area potential variation | Background fog | Residual image |
| Ex. 1 | 125 V | B | B | B | A |
| Ex. 2 | 105 V | A | A | A | B |
| Ex. 3 | 108 V | B | A | A | A |
| Ex. 4 | 113 V | A | B | A | A |
| Ex. 5 | 108 V | A | A | B | A |
| Ex. 6 | 102 V | A | A | A | B |
| Ex. 7 | 118 V | A | A | B | A |
| Ex. 8 | 107 V | A | A | A | B |
| Ex. 9 | 95 V | A | A | A | A |
| Comp. Ex. 1 | — | — | — | — | — |
| Comp. Ex. 2 | 95 V | B | B | C | B |
| Comp. Ex. 3 | 88 V | B | B | B | C |
| Comp. Ex. 4 | — | — | — | — | — |

For example, aspects of the present disclosure are as follows.

<1> An electrophotographic photoconductor including;

a support;

an undercoat layer; and a photoconductive layer, the undercoat layer and the photoconductive layer being disposed on the support in an order mentioned, wherein the undercoat layer includes zinc oxide particles, a urethane bond-containing resin, and methylethyl ketone oxime, and the undercoat layer satisfies a formula below:

$$10<M/L<400 \quad \text{(Formula)}$$

where M is a ratio (ppm) of the methylethyl ketone oxime included in the undercoat layer, and L is an average thickness (μm) of the undercoat layer.

<2> The electrophotographic photoconductor according to <1>, wherein the undercoat layer satisfies a formula below:

$$50<M/L<350. \quad \text{(Formula)}$$

<3> The electrophotographic photoconductor according to <1> or <2>, wherein the undercoat layer further includes a salicylic acid derivative.

<4> The electrophotographic photoconductor according to <3>, wherein the salicylic acid derivative is salicylic acid or 3,5-di-tert-butylsalicylic acid.

<5> The electrophotographic photoconductor according to any one of <1> to <4>, wherein an average thickness of the undercoat layer is from 7 μm through 25 μm.

<6> The electrophotographic photoconductor according to <5>, wherein the average thickness of the undercoat layer is from 7 μm through 15 μm.

<7> The electrophotographic photoconductor according to any one of <1> to <6>, wherein a ratio of the methylethyl ketone oxime included in the undercoat layer is from 200 ppm through 5,000 ppm.

<8> The electrophotographic photoconductor according to <7>, wherein the ratio of the methylethyl ketone oxime included in the undercoat layer is from 600 ppm through 3,000 ppm.

<9> The electrophotographic photoconductor according to any one of <1> to <8>, wherein an average particle diameter of the zinc oxide particles based on the number is from 20 nm through 200 nm.

<10> The electrophotographic photoconductor according to <9>, wherein the average particle diameter of the zinc oxide particles based on the number is from 50 nm through 150 nm.

<11> The electrophotographic photoconductor according to any one of <1> to <10>, wherein the support is a conductive support.

<12> The electrophotographic photoconductor according to <11>, wherein the support includes aluminium.

<13> The electrophotographic photoconductor according to any one of <1> to <12>, wherein the photoconductive layer includes a charge-generating layer and a charge-transporting layer.

<14> The electrophotographic photoconductor according to <13>, wherein the charge-transporting layer is disposed on the charge-generating layer.

<15> The electrophotographic photoconductor according to <13> or <14>, wherein an average thickness of the charge-generating layer is from 0.01 μm through 5 μm.

<16> The electrophotographic photoconductor according to <13> or <14>, wherein an average thickness of the charge-transporting layer is from 5 μm through 50 μm.

<17> An image forming apparatus including:

an electrophotographic photoconductor;

a charging unit configured to charge a surface of the electrophotographic photoconductor;

an exposure unit configured to expose the surface of the electrophotographic photoconductor charged to light to form an electrostatic latent image;

a developing unit configured to develop the electrostatic latent image with a toner to form a visible image; and a transfer unit configured to transfer the visible image to a recording medium, wherein the electrophotographic photoconductor is the electrophotographic photoconductor according to any one of <1> to <16>.

<18> A process cartridge including:

an electrophotographic photoconductor; and at least one selected from the group consisting of a charging unit configured to charge a surface of the electrophotographic photoconductor, an exposure unit configured to expose the surface of the electrophotographic photoconductor charged to light to form an electrostatic latent image, a developing unit configured to develop the electrostatic latent image with a toner to form a visible image, and a transfer unit configured to transfer the visible image to a recording medium, wherein the electrophotographic photoconductor is the electrophotographic photoconductor according to any one of <1> to <16>.

The electrophotographic photoconductor according to any one of <1> to <16>, the image forming apparatus according to <17>, and the process cartridge according to <18> can solve the above-described various problems existing in the art, and can achieve the object of the present disclosure.

What is claimed is:

1. An electrophotographic photoconductor, comprising:

a conductive support having a volume resistivity of $1\times10^{10}$ Ω·cm or less;

an undercoat layer; and a photoconductive layer, wherein the undercoat layer and the photoconductive layer being disposed on the conductive support in an order mentioned, wherein the undercoat layer comprises:

zinc oxide particles;

a urethane bond-containing resin; and methylethyl ketone oxime, wherein an average thickness of the undercoat layer is from 7 μm through 13.5 μm, and wherein the undercoat layer satisfies a formula below:

$$10<M/L<400 \quad \text{(Formula)}$$

where M is a ratio (ppm) of the methylethyl ketone oxime comprised in the undercoat layer, and L is an average thickness (μm) of the undercoat layer.

2. The electrophotographic photoconductor according to claim 1, wherein the undercoat layer satisfies a formula below:

$$50<M/L<350 \quad \text{(Formula)}$$

where M is a ratio (ppm) of the methylethyl ketone oxime comprised in the undercoat layer, and L is an average thickness (μm) of the undercoat layer.

3. The electrophotographic photoconductor according to claim 1, wherein the undercoat layer satisfies a formula below:

$$70<M/L<120 \quad \text{(Formula)}$$

where M is a ratio (ppm) of the methylethyl ketone oxime comprised in the undercoat layer, and L is an average thickness (μm) of the undercoat layer.

4. The electrophotographic photoconductor according to claim 1, wherein an average particle diameter of the zinc oxide particles based on the number is from 20 nm through 200 nm.

5. An image forming apparatus, comprising:
an electrophotographic photoconductor;
a charging unit configured to charge a surface of the electrophotographic photoconductor;
an exposure unit configured to expose the surface of the electrophotographic photoconductor charged to light to form an electrostatic latent image;
a developing unit configured to develop the electrostatic latent image with a toner to form a visible image; and
a transfer unit configured to transfer the visible image to a recording medium,
wherein the electrophotographic photoconductor is the electrophotographic photoconductor according to claim 1.

6. A process cartridge, comprising:
an electrophotographic photoconductor; and
at least one selected from the group consisting of
a charging unit configured to charge a surface of the electrophotographic photoconductor,
an exposure unit configured to expose the surface of the electrophotographic photoconductor charged to light to form an electrostatic latent image,
a developing unit configured to develop the electrostatic latent image with a toner to form a visible image, and
a transfer unit configured to transfer the visible image to a recording medium,
wherein the electrophotographic photoconductor is the electrophotographic photoconductor according to claim 1.

7. The electrophotographic photoconductor according to claim 1, wherein the undercoat layer further comprises at least one compound selected from the group consisting of salicylic acid, acetylsalicylic acid, 5-acetylsalicylic acid, 3-aminosalicylic acid, 5-acetylsalicylamide, 5-aminosalicylic acid, 4-azidesalicylic acid, benzyl salicylate, 4-tert-butylphenyl salicylate, butyl salicylate, 2-carboxyphenyl salicylate, 3,5-dinitrosalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4-methylsalicylic acid, 5-methylsalicylic acid, methyl thiosalicylate, 4-nitrophenyl salicylate, 5-nitrosalicylic acid, 4-nitrosalicylic acid, 3-nitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naphthoate, and phenyl 1-hydroxy-2-naphthoate.

8. An electrophotographic photoconductor, comprising:
a conductive support having a volume resistivity of $1\times10^{10}\Omega\cdot$cm or less;
an undercoat layer; and
a photoconductive layer,
wherein the undercoat layer and the photoconductive layer being disposed on the conductive support in an order mentioned,
wherein the undercoat layer comprises:
zinc oxide particles;
a urethane bond-containing resin; and
methylethyl ketone oxime,
wherein an amount of the methylethyl ketone oxime included in the undercoat layer is from 2,888 ppm to 5,000 ppm, and
wherein the undercoat layer satisfies a formula below:

$$10<M/L<400 \quad \text{(Formula)}$$

where M is a ratio (ppm) of the methylethyl ketone oxime comprised in the undercoat layer, and L is an average thickness (μm) of the undercoat layer.

9. The electrophotographic photoconductor according to claim 8, wherein the undercoat layer further comprises at least one compound selected from the group consisting of salicylic acid, acetylsalicylic acid, 5-acetylsalicylic acid, 3-aminosalicylic acid, 5-acetylsalicylamide, 5-aminosalicylic acid, 4-azidesalicylic acid, benzyl salicylate, 4-tert-butylphenyl salicylate, butyl salicylate, 2-carboxyphenyl salicylate, 3,5-dinitrosalicylic acid, dithiosalicylic acid, ethyl acetylsalicylate, 2-ethythexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4-methylsalcylic acid, 5-methylsalicylic acid, methyl thiosalicylate, 4-nitrophenyl salicylate, 5-nitrosalicylic acid, 4-nitrosalicylic acid, 3-nitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphihoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy- 1-naphthoic acid, 3-methoxy-2-naplithoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naphthoate, and phenyl 1-hydroxy-2-naphthoate.

10. The electrophotographic photoconductor according to claim 8, wherein the undercoat layer satisfies a formula below:

$$50<M/L<350 \quad \text{(Formula)}$$

where M is a ratio (ppm) of the methylethyl ketone oxime comprised in the undercoat layer, and L is an average thickness (μm) of the undercoat layer.

11. The electrophotographic photoconductor according to claim 8, wherein the undercoat layer satisfies a formula below:

$$70<M/L<120 \quad \text{(Formula)}$$

where M is a ratio (ppm) of the methylethyl ketone oxime comprised in the undercoat layer, and L is an average thickness (μm) of the undercoat layer.

12. An image forming apparatus, comprising:

an electrophotographic photoconductor;

a charging unit configured to charge a surface of the electrophotographic photoconductor;

an exposure unit configured to expose the surface of the electrophotographic photoconductor charged to light to form an electrostatic latent image;

a developing unit configured to develop the electrostatic latent image with a toner to form a visible image; and a transfer unit configured to transfer the visible image to a recording medium, wherein the electrophotographic photoconductor is the electrophotographic photoconductor according to claim 8.

13. A process cartridge, comprising:

an electrophotographic photoconductor; and at least one selected from the group consisting of a charging unit configured to charge a surface of the electrophotographic photoconductor, an exposure unit configured to expose the surface of the electrophotographic photoconductor charged to light to form an electrostatic latent image, a developing unit configured to develop the electrostatic latent image with a toner to form a visible image, and a transfer unit configured to transfer the visible image to a recording medium, wherein the electrophotographic photoconductor is the electrophotographic photoconductor according to claim 8.

* * * * *